United States Patent [19]

Kimura et al.

[11] Patent Number: 4,903,518

[45] Date of Patent: Feb. 27, 1990

[54] ROLL DRIVING APPARATUS FOR ROLLING MILL

[75] Inventors: Tomoaki Kimura, Hitachi; Teruo Sekiya, Takahagi, both of Japan

[73] Assignee: Hitachi, Ltd., Tokyo, Japan

[21] Appl. No.: 205,326

[22] PCT Filed: Oct. 9, 1987

[86] PCT No.: PCT/JP87/00762

§ 371 Date: Mar. 15, 1988

§ 102(e) Date: Mar. 15, 1988

[87] PCT Pub. No.: WO88/02668

PCT Pub. Date: Apr. 21, 1988

[30] Foreign Application Priority Data

Oct. 13, 1986 [JP] Japan ..... 61-241333

[51] Int. Cl.[4] ..... B21B 35/00

[52] U.S. Cl. ..... 72/249; 72/205; 475/332; 475/343

[58] Field of Search ..... 72/249, 205; 74/705, 74/720.5, 674

[56] References Cited

U.S. PATENT DOCUMENTS

| | | | |
|---|---|---|---|
| 2,513,285 | 7/1950 | Coe | 74/674 |
| 3,495,467 | 2/1970 | Herbay et al. | 72/249 X |
| 3,777,533 | 12/1973 | Munchbach | 72/249 X |
| 3,981,171 | 9/1976 | Kmelisch | 72/249 |
| 4,103,565 | 8/1978 | Matikainen et al. | 72/249 X |
| 4,194,382 | 3/1980 | Kajiwara | 72/249 X |
| 4,365,496 | 12/1982 | Shiozaki et al. | 72/249 |

FOREIGN PATENT DOCUMENTS

| | | | |
|---|---|---|---|
| 0196108 | 11/1983 | Japan | 72/249 |

*Primary Examiner*—W. Donald Bray
*Assistant Examiner*—Steve Katz
*Attorney, Agent, or Firm*—Fay, Sharpe, Beall, Fagan, Minnich & McKee

[57] ABSTRACT

A driving apparatus in which power of a single motor is distributed to two shafts by a cam roller, whereupon the power quantities of the respective shafts are transmitted to working rolls through speed reducers.

By employing planetary reduction gears of the inner gearing type as each of the speed reducers, it is permitted to transmit a great torque with small gears.

5 Claims, 2 Drawing Sheets

ROLL DRIVING APPARATUS FOR ROLLING MILL

DESCRIPTION

1. Technical Field

The present invention relates to a roll driving apparatus for a rolling mill in which a metal material is continuously rolled by working rolls, and more particularly to a roll driving apparatus adapted to drive a pair of working rolls by means of driving forces from an identical motor.

2. Background Art

Regarding the working rolls of a rolling mill, an arrangement has heretofore been such that the output shaft of a single motor is connected to a speed reducer, that the output shaft of the speed reducer is furnished with distributing gears called a "cam roller," so as to distribute power to two shafts, and that the working rolls are connected to the two shafts. A driving mechanism which adopts such an arrangement is disclosed in, for example, the specification of U.S. Pat. No. 3495467.

This prior-art apparatus for driving the working rolls requires the cam roller to endure a great torque in order that a torque intensified by the speed reducer may be distributed to the two shafts. The cam roller is composed of the two gears, the intermeshing parts of which transmit the torque. That is, since the torque is transmitted by the meshing of one pair of gears, these gears need to be large in order to transmit the intensified torque mentioned above. In this manner, in the case where the torque is intensified by the speed reducer and is thereafter distributed to the two shafts by the cam roller, there is the disadvantage that the cam roller becomes a large-scale equipment. Especially in recent plate rolling, the cam roller has tended to become large in size for the reason that the power of the motor reaches 10,000 kW and that the driving torque of each of the working rolls needs to be as great as 100 tons-m.

DISCLOSURE OF THE INVENTION

An object of the present invention is to provide a driving apparatus which can reduce the size of the installation of the whole driving system for driving a pair of working rolls by means of power from a single motor.

The present invention is characterized in that an output torque from a single motor is first distributed to two shafts by a cam roller, that torques are thereafter intensified by planetary reduction gears disposed on the respective shafts, and that the intensified torques are respectively transmitted to working rolls.

BEST MODES FOR CARRYING OUT THE INVENTION

Figure 1:
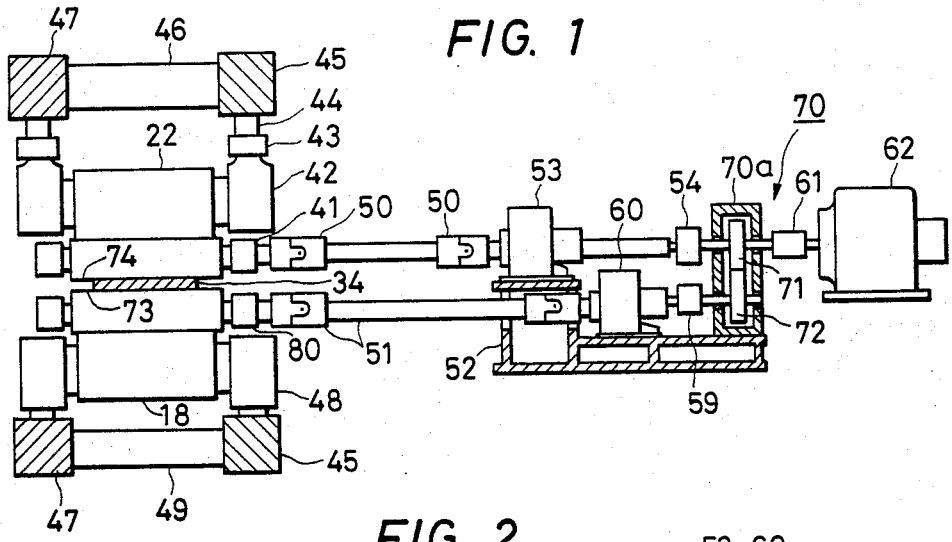
FIG. 1 is a fundamental arrangement view of a working roll-driving apparatus which is an embodiment of the present invention.

The first embodiment of the present invention is shown in FIG. 1. It is an example in the case of a quadruple rolling mill which is the most common. The rolling mill has an outer frame formed in such a manner that right and left stands 45, 47 are connected by joint beams 46, 49. Contained in the outer frame are four reincforcing rolls 22, 18 which are journaled in bearing boxes 42, 48, and also two working rolls 73, 74 which extend a material to-be-rolled 24 and which are journaled in bearing boxes 41, 80. A hydraulic cylinder 43 and a pressure block 44 for controlling the plate thickness of the material to-be-rolled 34 are mounted on the top part of each bearing box 42 for the reinforcing roll 42. The working rolls 73, 74 of such a rolling mill are driven as stated below.

The power of a single motor 62 is transmitted through a coupling 61 to a cam roller 70 which distributes this power to two shafts. The cam roller 70 is so configured that two gears 71, 72 are included in a casing 70*a*.

As regards the shaft on the upper side, the power distributed to the two shafts by the cam roller 70 is transmitted through a coupling 54 to a speed reducer 53 for intensifying a torque. The power regarding the lower shaft is similarly guided through a coupling 59 to a speed reducer 60. The torques distributed to the two shafts and intensified by the speed reducers in this manner, are respectively transmitted to the aforementioned two working rolls 74, 73 by spindles 50, 51.

Incidentally, the cam roller and the two speed reducers 53, 60 stated above are mounted on a base 52.

Figure 2:
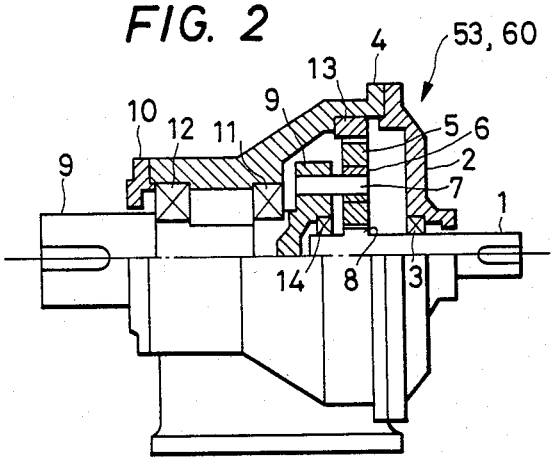
FIG. 2 is a half-sectional view of planetary reduction gears.
Figure 3:
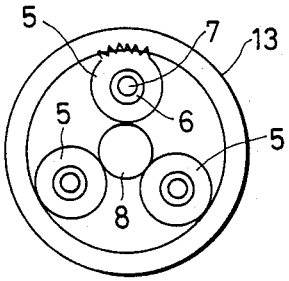
FIG. 3 is a view showing the meshing situation of gears in the reduction gears of FIG. 2.

Here, the present invention is characterized in that planetary reduction gears of the inner gearing type as shown in FIG. 2 are employed as each of the torque-intensifying speed reducers 53, 60 of the roll driving system of such a rolling mill. The input of this speed reducer is applied to a shaft 1 which is supported by bearings 3, 14. The input shaft 1 is provided with a sun gear 8. A plurality of planet gears 5 mesh with the sun gear 8, and they also mesh with an inner gearing wheel 13 which is fixed to a casing 4. An output shaft 9 is provided with pins 7, which are inserted centerally of the planet gears 5, and bearings 6 are so disposed that the pins 7 can rollingly rotate relative to the corresponding planet gears 5. The input shaft 1 is journaled in the bearing 3 embraced by a casing 2, and the bearing 14 embraced by the output shaft 9. The meshing states of the respective gears in this speed reducer are schematically illustrated in FIG. 3. The planet gears 5 numbering three mesh with the gear 8 of the input shaft, and they mesh with the inner gearing wheel 13. Since, in this manner, there are three meshing points, a great torque can be transmitted by small gears, and the size of the speed reducer can be made small.

Figure 4:
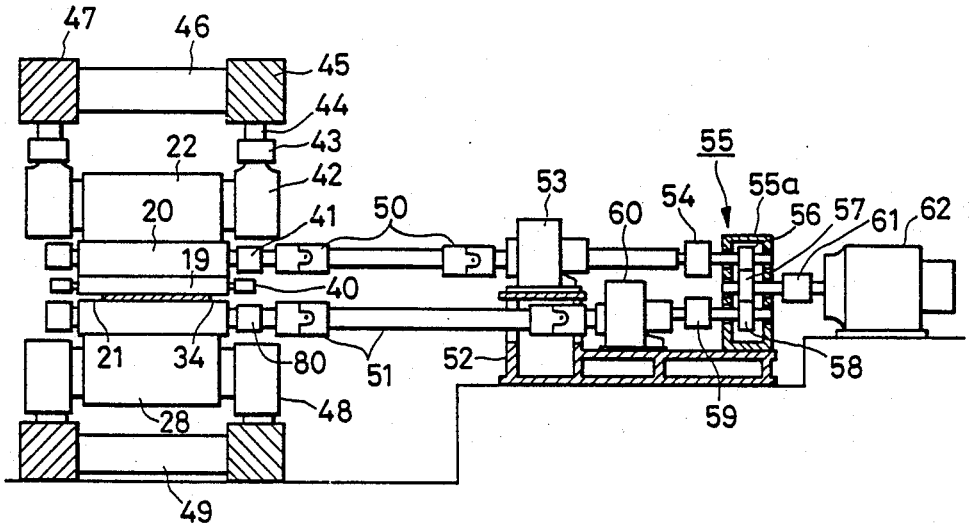
FIG. 4 is a fundamental arrangement view showing another embodiment of the present invention.

In the case where two speed reducers are disposed on the output side in this fashion, there is the problem that the distance between the upper and lower shafts often increases, to render the performance of the present invention impossible on some occasions. On these occasions, as illustrated in FIG. 4, a working roll 19 on one of the sides holding the material to-be-rolled therebetween is made undriven, and an intermediate roll 20 is disposed anew and is driven, whereby the distance between driven rolls 20, 21 can be enlarged. Such a quintuple rolling mill having the five rolls is advantageous in simultaneously achieving the effect that, as stated in the official gazette of Japanese Patent Application Laid-open No. 112249/1978, the undriven working roll 19 journaled in bearing boxes 40 can have its diameter reduced to lighten a rolling load.

By the way, as a cam roller 55 for distributing the power of the motor 62 in FIG. 4, there is employed a scheme in which three gears 56, 57, 58 are contained in a casing 55*a* . Thus, the rotating directions of the rolls are conformed.

As conjectured from the example of FIG. 4, the interaxial distance of the driven rolls may well be increased by relinquishing the drive of the working roll 21 as well as the intermediate roll 20 and driving reinforcing rolls 22, 28.

In the above, the measures for lengthening the interaxial distance of the two speed reducers have been described. However, it is also effective for realizing the performance of the present invention that, as shown in FIG. 1 and FIG. 4, the arrayed positions of the two speed reducers 53, 60 are shifted so as not to interfere with each other, thereby to shorten the interaxial distance between both the speed reducers.

Although, in FIG. 1 or 4, the cam roller 70 or 55 is arranged directly on the outgoing side of the motor, it is also possible that a reduction gear or a speed-up gear having some speed regulaing ratio can be interposed between the motor and the cam roller as needed in design. Also in this case, the two speed reducers for the torque intensification can be disposed behind the cam roller achieve the effects of the present invention similarly. This case is naturally covered within the scope of the present invention.

According to the embodiments, each of the speed reducers for intensifying the torques behind the cam roller is constructed of the planetary reduction gears shown in FIG. 2, so that it becomes a small-sized speed reducer economically.

The two speed reducers are arranged so as to be staggered from each other, whereby the interaxial distance between the speed reducers can be shortened, and at least one of the working rolls on both the sides of the material to-be-rolled is made undriven as shown in FIG. 4, whereby a space for enlarging the interaxial distance of the speed reducers can be provided.

EFFECTS OF THE INVENTION

According to the present invention, the following effects are attained:

1. Since a cam roller for distributing the power of a single motor is disposed at a stage preceding speed reducers, the transmission torque thereof becomes small, and a small-sized cam roller can be employed.

2. Since planetary reduction gears of the inner gearing type are employed as the speed reducer, meshing parts for torque transmission become complicated, and a great torque can be transmitted by small gears.

3. The planetary reduction gears are so arranged as to be axially staggered from each other, whereby the distance between two shafts can be shortened.

What is claimed is:

1. A roll driving apparatus for a rolling mill having a pair of working rolls and a plurality of support rolls, comprising:

a single motor for driving a plurality of the rolls, a pair of spindles connected with a pair of said rolls, a cam roller for distributing power from the motor to the pair of spindles and a pair of speed reducers disposed on the respective driving shafts for torque intensification; and each said speed reducer having an inner gearing type planetary reduction gear and a casing respectively, said casing of the planetary reduction gear being fixed for rotation therewith.

2. A roll driving apparatus for a rolling mill as defined in claim 1, further comprising:

said inner gearing type planetary reduction gear casing having an inner gearing wheel on the inside thereof, a sun gear engaging an input shaft connected with the output side of the cam roller, and a plurality of planet gears engaging an output shaft connected with the spindle and being meshed with both of the sun gear and the inner gearing wheel.

3. A roll driving apparatus for a rolling mill according to claim 1, further comprising at least one of said two working rolls having a material to-be-rolled interposed therebetween being undriven, and a driven supporting roll for supporting the undriven working roll.

4. A roll driving apparatus according to claim 1, further comprising that among said rolls disposed on both sides of a material to-be-rolled, rolls on one side of the material include one of the pair of working rolls and one of a pair of reinforcing rolls of which one of said rolls is driven, while rolls on the other side of the material to-be-rolled include the other of the pair of working rolls that is not driven, an intermediate roll and the other of the pair of reinforcing rolls, wherein said intermediate roll drives said reinforcing roll.

5. A roll driving apparatus according to claim 1, wherein said speed reducers for intensifying the power torques distributed to said two shafts by said cam roller are arranged so as to be staggered from each other for shortening a distance between axes of said speed reducers.

* * * * *